US006052473A

United States Patent [19]

Clavadetscher et al.

[11] Patent Number: 6,052,473

[45] Date of Patent: Apr. 18, 2000

[54] MEMBRANE CONSTITUTING THE CIRCUMFERENTIAL SURFACE OF A HEARING AID TO BE INDIVIDUALIZED BY A CAST BODY

[75] Inventors: Jürg Clavadetscher, Ortschwaben; Marcel Aeschlimann, Biel, both of Switzerland

[73] Assignee: Bernafon AG, Bern, Switzerland

[21] Appl. No.: 08/899,417

[22] Filed: Jul. 23, 1997

[30] Foreign Application Priority Data

Jul. 24, 1996 [CH] Switzerland ..... 1861/96

[51] Int. Cl.[7] ..... H04R 1/02

[52] U.S. Cl. ..... 381/322; 381/324

[58] Field of Search ..... 381/322, 324, 381/325, 329, 330, 380

[56] References Cited

U.S. PATENT DOCUMENTS 4,617,429 10/1986 Bellafiore ..... 381/322
4,834,927 5/1989 Birkholz et al. ..... 381/324
4,870,688 9/1989 Voroba et al. ..... 381/322
5,530,763 6/1996 Aebi et al. ..... 381/322

*Primary Examiner*—Wing F. Chan
*Assistant Examiner*—Rexford N. Barnie
*Attorney, Agent, or Firm*—Milton Oliver; Ware, Fressola, Van Der Sluys & Adolphson LLP

[57] ABSTRACT

An elastic membrane (14) forms the circumferential surface of a hearing aid which is individualized by a body cast in an auditory canal or in a model of an auditory canal. The membrane (14) defines a casting cavity before and during the casting and surrounds the appliance closely in its individualized condition. The membrane is substantially tubular and has thickened, integrated fastening rings (32, 33) around its outer opening (30) and its inner opening (31) with which it is fastenable to other components of the hearing aid. The membrane has a thickness of ca. 0.2 mm in its central region and a thickness of e.g. 1 mm in the thicker end regions. The membrane (14) with the integrated fastening rings (32, 33) is advantageously produced from e.g. a thermoplastic elastomer or from a highly extensible silicon-plastic by injection moulding.

13 Claims, 3 Drawing Sheets

MEMBRANE CONSTITUTING THE CIRCUMFERENTIAL SURFACE OF A HEARING AID TO BE INDIVIDUALIZED BY A CAST BODY

FIELD OF THE INVENTION

The invention is in the field of hearing aids and concerns a membrane which forms the circumferential surface of a hearing aid which has the form of an irregular frustum or cylinder. The membrane substantially serves as extensible confinement of a casting cavity into which a body is cast for adapting the appliance to an individual auditory canal.

BACKGROUND OF THE INVENTION

Various hearing aids have been described which are individualized for a specific person by casting its body in the auditory canal of this person or in a model of this person's ear canal. If this casting step is substantially the last process step and can be carried out simply, i.e. without complicated devices, this kind of hearing aid can be supplied to auditory advisors in a general condition, i.e. in a condition in which it has not yet been adapted to an individual auditory canal. The auditory advisor can adapt the appliance to the auditory canal of a specific person, i.e. cast the body, and deliver after only one session the finished appliance ready to be worn by the person.

Such simple individualization implies in particular that all components serving the hearing function (microphone and/or receiving coil, amplifier-chip and loudspeaker) are already integrated in the general hearing aid and that this general hearing aid comprises a casting cavity in which the individual body is cast such that the body does not require any further processing after casting.

An adaptation to an individual auditory canal is important for hearing aids worn partly in the auditory canal ("In-The-Canal-appliances" or ITC-appliances) and especially for hearing aids carried completely in the auditory canal ("Completely-In-the-Canal-appliances" or CIC-appliances). These appliances substantially have the form of an irregular frustum or cylinder with an inner face orientated towards the inside of the ear, an outer face orientated towards the outside and a circumferential surface, whereby the circumferential surface only has to be adapted to the form of the individual auditory canal.

Hearing aids which fulfil the requirements of a simple individualizability are e.g. described in publication EP-629101 and in a parallel application to the present application (Swiss application No. 1859/96). The hearing aids described in both cases comprise in their general condition a face plate with a battery opening defining the outer face and at least partly supporting elements which keep the loudspeaker in particular in a defined position relative to the front plate, i.e. at least within a defined distance from the face plate, such that these supporting elements and/or the outlet side of the loudspeaker substantially constitute the inner face of the appliance. The appliances further comprise a substantially tubular extensible membrane forming the circumferential surface which membrane is fastened around the outer face (face plate) and around the inner face (loudspeaker and/or further elements) such that they form a tight casting cavity together with the face plate and the loudspeaker and/or further elements in the region of the inner face, which cavity can be filled with a casting material through a pouring opening in the region of the face plate. The general appliance is positioned in the auditory canal of a potential wearer or in a corresponding model for casting. Through casting, the extensible membrane is pressed closely to the wall of the auditory canal such that the cast body of the appliance individualized in such a manner is adapted precisely to the auditory canal and carries the membrane on its circumferential surface.

A membrane forming the circumferential surface of a hearing aid must fulfill the most varied conditions:

The membrane must be extensible and flexible to such a degree that on casting it applies itself very closely to the wall of the auditory canal (or the wall of a corresponding model) without folds.

The membrane, as contacting element between hearing aid and skin, must be suited for constant and close contact with skin, i.e. it must be compatible with skin to a high degree.

The membrane must have a sufficient mechanical strength for the general appliance (with empty casting cavity, i.e. without body) to be able to be produced without problems and to be handled safely.

The membrane must be fastenable simply to the components of the hearing aid.

In addition, membranes which are so porous that they are permeable to air yet impermeable to a casting material are advantageous, not only for the casting of the body but also concerning the comfort when the hearing aid is worn.

For fixing the membrane to the face plate and to the loudspeaker and/or supporting element in the region of the inner face, clamping elements (fixing rings or locking elements with corresponding openings which elements reach over the whole faces) have been suggested or direct gluing or welding of the membrane to the face plate and to the supporting elements in the region of the inner face. It now appears that especially for CIC-appliances which are extremely small the fastening of the described membranes with the described fastening means and according to the described fastening methods is a step which is rather difficult to be carried out and is therefore costly. The reason for this is the sensitivity of the very thin (ca. 0.2 mm) membrane and the small size of the separate fastening means.

SUMMARY OF THE INVENTION

An object of the invention is to provide a membrane for an ITC-hearing-aid or a CIC-hearing-aid which is more easily fastenable to other parts of the appliance than corresponding membranes according to the state of the art.

The inventive membrane makes use of the fact that the force which is necessary to stretch a material or the elastic force which the stretched material exerts is not only dependant on the characteristics of the material but also on the thickness (wall thickness) of the material. The inventive membrane correspondingly comprises regions with different wall thicknesses as regions for different functions. Regions with larger wall thickness (larger elastic force) serve in particular as elastic connection means; regions with a smaller wall thickness (smaller resistance against stretching) especially serve as extensible confinement of the casting cavity. Further regions with further wall thicknesses can be provided for further functions.

This means that fastening means are directly integrated into the inventive membrane which substantially leads to two advantages: firstly the fastening position of the membrane is precisely defined and independent of the individual course of the fastening process and secondly no second part (clamping ring) to be handled separately is necessary. These two advantages lead to a considerable simplification of the fastening process and to a more uniform result.

The inventive membrane is advantageously produced from e.g. a silicon-plastic in an injection molding process, whereby the fastening means are molded as regions with larger wall thickness.

Advantageous materials for the inventive membrane are e.g. thermoplastic elastomers or highly extensible silicon-plastics (e.g. two-component-silicons) with an extendibility of more than 500% and a Shore hardness of less than 40.

BRIEF DESCRIPTION OF THE DRAWINGS

Embodiments of the inventive membrane are described in detail in connection with the following Figures, in which.

DETAILED DESCRIPTION OF PREFERRED EMBODIMENTS

Figure 2:
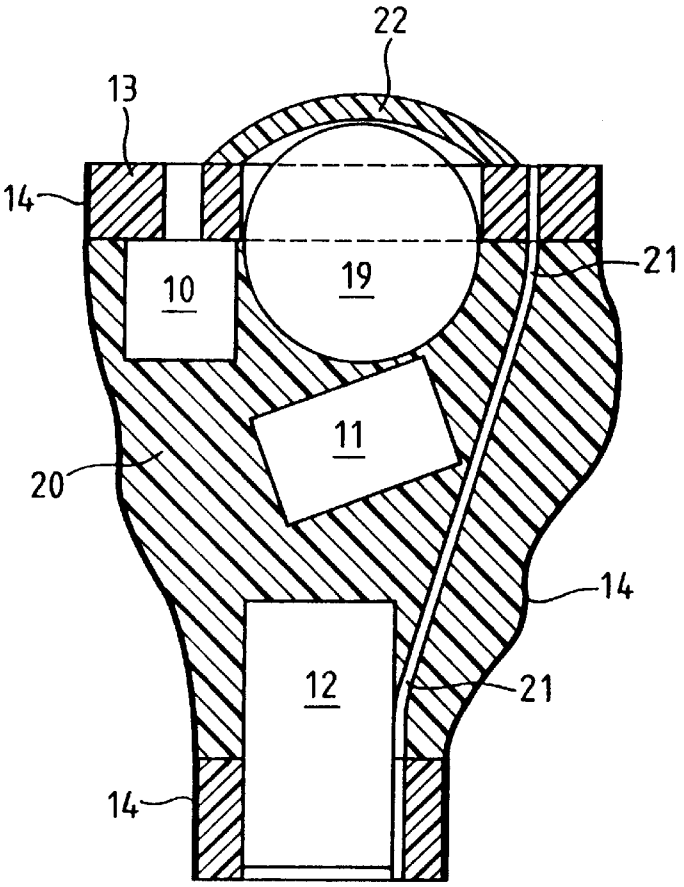
FIG. 2 is a side elevation similar to FIG. 1 after filling the membrane with casting material to conform to the configuration of the auditory canal.
Figure 1:
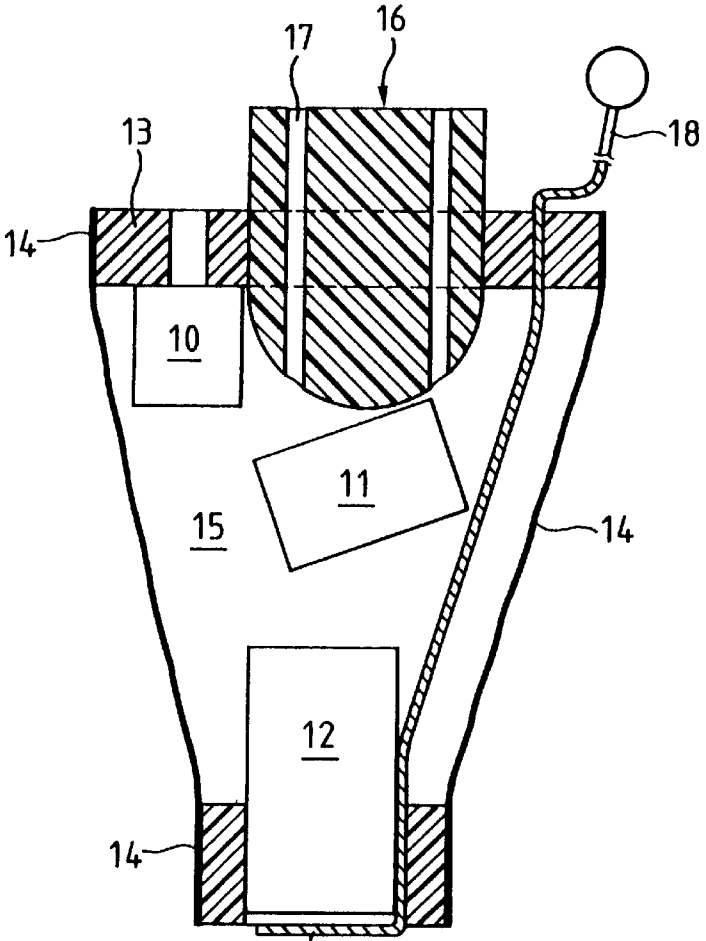
FIG. 1 is a side elevation, in section parallel to the axis of the appliance, of a hearing aid having a membrane according to the invention in a general condition, i.e., before the introduction of casting material.

FIGS. 1 and 2 show an embodiment of the inventive hearing aid in section parallel to the axis which hearing aid is individualized, i.e., customized in FIG. 2, to an individual auditory canal by casting of a body in an auditory canal or in a model of an auditory canal. For casting the body, a membrane forming the circumferential surface of the appliance is provided. The hearing aid is shown in its general condition (FIG. 1), i.e. before the casting of the body and in its individualized condition (FIG. 2), i.e. after the casting of the body. The shown hearing aid is a CIC-appliance. The appliance itself is subject of a parallel application to the present application (U.S. Ser. No. 08/899,415) and for this reason is not described here. The inventive membrane is not only applicable to a hearing aid as described in FIGS. 1 and 2 but also to other hearing aids which are individualized by casting a body in a casting cavity, e.g. to a hearing aid as described in the publication EP-629101.

The shown hearing aid comprises e.g. a microphone 10, an amplifier-chip 11 and a loudspeaker 12 as components serving the hearing function and a face plate 13 with a battery opening or with a battery rack, wherein the face plate 13 substantially constitutes the outer face and the outlet-side of the loudspeaker 12 substantially constitutes the inner face of the appliance.

FIG. 1 shows the appliance in its general condition. A substantially tubullar membrane 14 extends form the outer face to the inner face and forms the circumferential surface of the appliance. The membrane confines a casting cavity 15 which is filled with a casting material through a pouring opening in a casting template 16. The casting template 16 is positioned in the battery opening of the face plate 13 and primarily serves for moulding a battery rack between the body to be cast and the face plate. The general hearing aid further comprises provisional supporting means 18 which protrude from the outer and inner faces of the appliance and are removed after the casting of the body.

It shows that in its general condition the appliance does not necessarily need a supporting element extending axially through the appliance. A flexible element which limits the distance between the inner and the outer face of the appliance is sufficient. Such a flexible length-limiting element can also be removed from the hearing aid after casting.

FIG. 2 shows the same appliance as FIG. 1 but in its individualized condition, i.e. after the casting of the body. The individualized appliance differs from the general appliance in that it has a body 20, in that the provisional supporting element 18 (or the flexible length-limiting element respectively) is absent, in that by removal of the provisional supporting element a ventilation channel has been formed and in that there is a battery 19 replacing the casting template and a battery cover 22. The membrane 14 still constitutes substantially the circumferential surface of the appliance and surrounds the body 20 closely.

Figure 3:
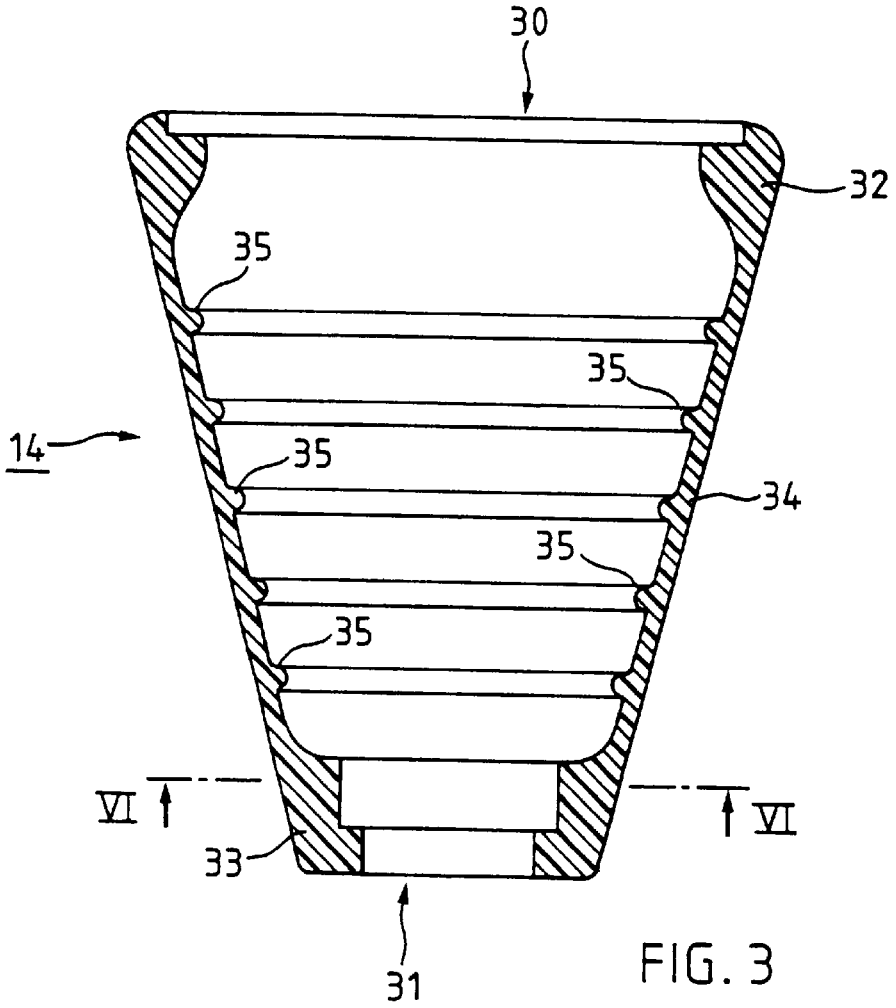
FIG. 3 is a side elevation of an embodiment of the inventive membrane in section parallel to the axis.

FIG. 3 shows an embodiment of the inventive membrane 14 in section parallel to the axis. The membrane is substantially tubular and comprises an outer opening 30 and an inner opening 31. Around the two openings outer fastening means 32 and inner fastening means 33 are arranged which fastening means are regions in which the wall thickness is larger than in a central region 34 of the membrane. In the shown example the outer fastening means are designed as an elastic ring which for fastening of the membrane to a face plate is e.g. positioned in a corresponding groove in this face plate in which it advantageously lies in a somewhat tensed condition. The inner fastening means 33 have the form of a tube which is stepped on the inside and has an inner opening adapted to a loudspeaker such that a loudspeaker positioned in this opening is held in the opening by stretching the tube elasticly.

The central region 34 of the membrane is stretched when casting the body. In order to make this stretching as even as possible this region 34 may comprise a pattern of further regions with increased wall thickness, whereby the wall thickness in these regions is considerably smaller than in the regions of the fastening means. This kind of pattern e.g. consists of enlargements 35 in form of lines extending around the inner circumference of the tubular membrane.

With this kind of pattern of enlargements 35 disadvantageous effects which are caused by weak points in the membrane can be prevented. If a membrane without this kind of enlargements has a weak point it is stretched preferentially in this point by the pressure created in the primary stage of the casting. By such preliminary stretching, the point is weakened further and stretched even further with further casting. Thus, unwanted humps are formed. Through their increased wall thickness, the elements of the named pattern have an extendibility much less influenced by weak points such that a pattern as described is able to prevent the named, unwanted effects.

If the pattern of enlargements instead of consisting of circumferential rings on the inside of the membrane as shown in FIG. 3, consists of axially extending lines which are accordingly dimensioned these lines may serve for limiting the axial length of the hearing aid in addition to their function of making the extensibility of the membrane more even. This additional function is important because it is to be absolutely prevented that the hearing aid becomes longer through lengthwise extension of the membrane and therefore touches the ear drum during casting. If the length-limiting function can be taken over reliably by the membrane, not only the provisional supporting element but also the flexible length-limiting element are not needed.

Typical wall thicknesses for a tubular membrane as shown in FIG. 3 are e.g.:

central region: 0.1 to 0.3 mm outer fastening means: ≧0.5mm inner fastening means: ≧0.5 mm pattern of enlargements in central region: 0.2 to 0.5 mm (larger by ca. a factor 2 than remaining wall thickness of central region)

Further embodiments of the inventive membrane which are deriveable from the embodiment shown in FIG. 3 e.g. only comprise fastening means in the region of the outer opening, while the region of the inner opening is e.g. fastened to further elements of the hearing aid by means of gluing or welding. Fastening means can be provided in the region of the inner opening which, similar to the shown outer fastening means, are a fastening ring which is positioned in a groove in corresponding inner supporting elements. The outer and/or inner fastening means can, instead of being fastened with positive engaging means (ring in groove) be fastened to other correspondingly designed components of the hearing aid with or without elastic stretching by material connection (gluing or welding).

Figure 4:
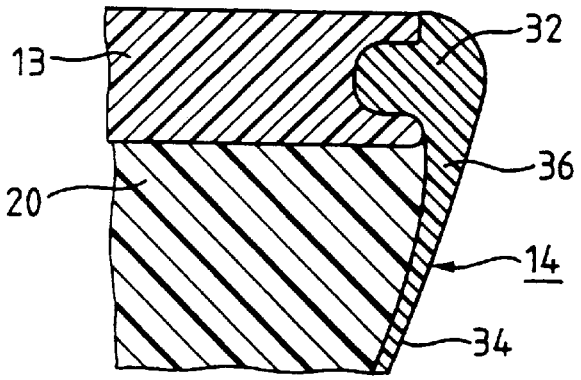
FIG. 4 is a partial side elevation, in section, of attachment of an inventive membrane to a face plate or a supporting element in the region of the inner face.

FIG. 4 shows the outer fastening means of the membrane according to FIG. 3 in a larger scale. Visible are parts of the face plate 13, of the body 20 and of the membrane 14, in particular the outer fastening means 32 and the central region 34. It is evident from the Figure that the thickness of the membrane increases continuously from the central part of the membrane 14 towards its part serving as fastening means 32 to the face plate 13.

Between the outer fastening means 32 having the form of a thickened edge and the thin central region of the membrane a continuous transitional region 36 is provided. This increases the stability of the membrane in this transitional region and increases the strength of a connection between face plate 13 and body 20 if the body is cast from a material which forms a stable connection with the material of the membrane, e.g. by anchorage of the casting material in the pores of the membrane or by an adhesive/chemical connection between casting material and membrane material.

Figure 5:
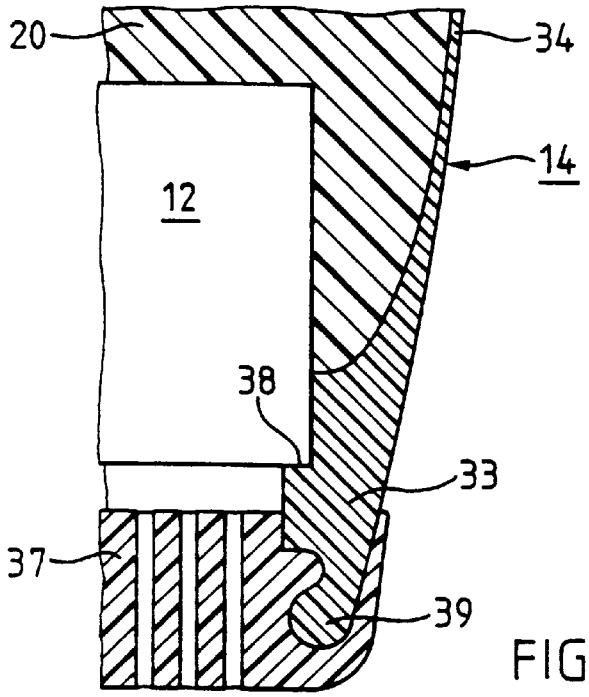
FIG. 5 is a partial side elevation of the attachment of an inventive membrane to the loudspeaker of a hearing aid (in section parallel to the axis)

FIG. 5 shows a further embodiment of inner fastening means 33 integrated into a membrane 14. Visible are the loudspeaker 12 and parts of the membrane 14, in particular the inner fastening means 33 and the central region 34. Furthermore, a perforated protection cap 37 is shown which is attached in a positively engaged manner to the outermost edge of the fastening means 32 by means of a snap connection, the outermost edge being designed as positive engaging means 39. The protection cap 37 has the purpose to protect the outlet of the loudspeaker from being contaminated with cerumen. The actual fastening means 32 have the form of an elastic tube which advantageously comprises a step 38. The tube and the step are dimensioned such that the loudspeaker can be introduced as far as the step, whereby the tube is stretched such that the loudspeaker is held in this position by the elastic force exercised by the stretched tube.

As previously mentioned the inventive membrane is advantageously produced by injection moulding. With injection moulding it is possible to mould together materials which are different from each other to a limited degree such that these materials are connected to each other by very stable joints. It is therefore possible to employ a slightly harder material e.g. for the positive engaging means 39, than for the rest of the membrane, especially in the region of the inner fastening means as shown in FIG. 5.

Figure 6:
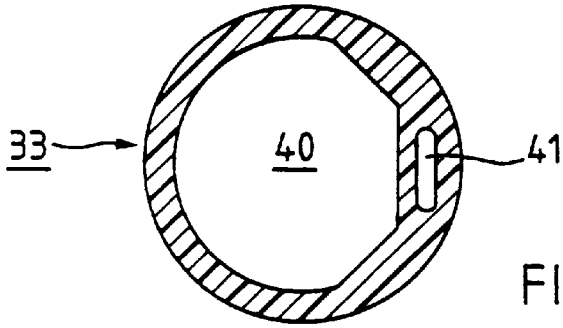
FIG. 6 is a transverse sectional view along line VI—VI of FIG. 3 of a portion for fastening an inventive membrane to the loudspeaker of a hearing aid, which connecting means also has an opening for a ventilation channel.
Figure 7:
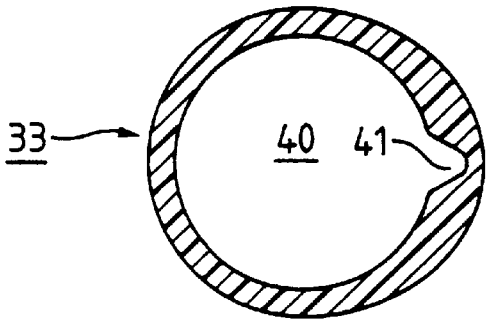
FIG. 7 is a sectional view similar to FIG. 6 of a further fastening means.

An example of pairing of materials for production of fastening means 39 is the following:

membrane and fastening means: thermoplastic elastomers or highly extensible silicons positive engaging means: polyamide FIGS. 6 and 7 show sections perpendicular to the axis (section line VI—VI in FIG. 3) through exemplified embodiments of inner fastening means as used for the hearing aid according to FIGS. 1 and 2. In its general condition, the hearing aid according to FIGS. 1 and 2 has a provisional supporting element (18 in FIG. 1) or a corresponding length-limiting element protruding over both faces which both are removed from the appliance after the body has been cast by pulling them out of the appliance. Provisional supporting element as well as flexible length-limiting element both need openings in both faces, which openings are openings of a ventilation channel in the individualized condition of the appliance. The fastening means according to FIGS. 6 and 7, in addition to its features serving the function for fastening the membrane to the loudspeaker, has an opening to be the inner opening of a ventilation channel.

Both FIGS. 6 and 7 show the tubular fastening means 33 which comprises due to its double function, a first opening 40 for the loudspeaker and a second opening 41 for the ventilation channel or for the provisional supporting element or flexible length-limiting element respectively. In FIG. 6 the second opening 41 is designed as a separate opening, in FIG. 7 as a dent in the first opening 40. In both cases, a sleeve can be provided in the second opening 41, whereby in the case according to FIG. 7 the sleeve is additionally fastened to the loudspeaker, e.g. by gluing.

What is claimed is:

1. A membrane for the outer covering of a hearing aid having a filling opening for casting material, the membrane comprising a generally tubular elastic body having a central portion and openings at opposite ends for attachment to inner and outer ends of said hearing aid, said central portion surrounding and covering said hearing aid between said inner and outer ends and defining a casting cavity around said hearing aid between said ends;

a thickened portion on at least one of said ends of said body forming attachment means for attaching said body to said ends of said hearing aid; and said casting cavity within said membrane being fillable with casting material through said filling opening when said membrane and said hearing aid are in an auditory canal of an intended wearer, or a mold of said auditory canal, to mold said membrane to the shape of said auditory canal.

2. A membrane according to claim 1 wherein a thickened portion attachable to said inner end of said hearing aid for engaging a loudspeaker comprises first and second adjacent circular openings on the inside of said thickened portion, said first opening being farthest from said outer end and having a smaller diameter than said second opening, forming a shoulder between said openings.

3. A membrane according to claim 1 including a protective cap to be received in said opening at said outer end of said hearing aid, and wherein said thickened portion around said opening at said outer end includes means for positively engaging said cap.

4. A membrane according to claim 3 wherein said means for positively engaging comprises a material less elastic than the remainder of said membrane.

5. A membrane according to claim 2 comprising a ventilation channel having an opening adjacent said opening for engaging said loudspeaker.

6. A membrane according to claim 5 wherein said opening for said ventilation channel comprises a dent in a side of said opening for engaging said loudspeaker.

7. A membrane according to claim 1 wherein said central portion comprises a pattern of wall thickness enlargements.

8. A membrane according to claim 7 wherein said enlargements comprise annular lines extending around an inner surface of said membrane.

9. A membrane according to claim 7 wherein said enlargements comprise axially extending lines for limiting the axial length of said membrane.

10. A membrane according to claim 9 wherein said enlargements have a thickness about twice the thickness of membrane between said lines.

11. A membrane according to claim 1 wherein said membrane comprises a thermoplastic elastomer or a highly elastic silicon plastic.

12. A membrane according to claim 11 having wall thickness of 0.1 to 0.3 mm in its thinnest regions.

13. A membrane according to claim 11 produced by injection molding using one or more materials.

* * * * *